US009282781B2

(12) United States Patent
Davis et al.

(10) Patent No.: US 9,282,781 B2
(45) **Date of Patent: *Mar. 15, 2016**

(54) FOOTWEAR WITH EXPANDABLE ENTRY AND EXIT FEATURE

(75) Inventors: Russell L. Davis, Wynne, AR (US); Danielle Cojuangco Abraham, San Francisco, CA (US)

(73) Assignee: Ariat International, Inc., Union City, CA (US)

( * ) Notice: Subject to any disclaimer, the term of this patent is extended or adjusted under 35 U.S.C. 154(b) by 255 days.

This patent is subject to a terminal disclaimer.

(21) Appl. No.: 13/167,082

(22) Filed: Jun. 23, 2011

(65) Prior Publication Data

US 2011/0252666 A1 Oct. 20, 2011

Related U.S. Application Data

(63) Continuation of application No. 12/187,163, filed on Aug. 6, 2008, now Pat. No. 7,980,010.

(51) Int. Cl.

| | |
|---|---|
| ***A43B 11/00*** | (2006.01) |
| ***A43B 3/04*** | (2006.01) |
| ***A43B 23/04*** | (2006.01) |

(52) U.S. Cl.

CPC . *A43B 3/04* (2013.01); *A43B 11/00* (2013.01); *A43B 23/047* (2013.01)

(58) Field of Classification Search

CPC ..... A43B 11/00; A43B 11/02; A43B 23/02; A43B 23/045; A43B 23/047; A43B 23/0295; A43B 23/0235

USPC ..... 36/138, 102, 105, 45, 50.1, 51, 88, 93, 36/83

See application file for complete search history.

(56) References Cited

U.S. PATENT DOCUMENTS

| | | | | |
|---|---|---|---|---|
| 1,841 | A | 10/1840 | DuPont et al. | |
| 170,611 | A | 11/1875 | Ward | |
| 236,323 | A * | 1/1881 | Graf | 36/51 |
| 330,176 | A * | 11/1885 | Walker | 36/51 |
| 354,968 | A | 12/1886 | Cushing | |
| 378,988 | A * | 3/1888 | Warren | 36/51 |
| 546,065 | A * | 9/1895 | Craven | 36/9 R |
| 970,381 | A | 9/1910 | Mueller | |
| 1,704,688 | A * | 3/1929 | Valentine et al. | 36/7.3 |
| 2,343,477 | A | 3/1944 | Ross | |

(Continued)

FOREIGN PATENT DOCUMENTS

| | | |
|---|---|---|
| DE | 3519440 A1 | 1/1986 |
| DE | 29808178 U1 | 9/1998 |

(Continued)

OTHER PUBLICATIONS

International Search Report and Written Opinion for PCT Patent Application No. PCT/US2009/051577, Sep. 15, 2009.

(Continued)

*Primary Examiner* — Jila M Mohandesi

(74) *Attorney, Agent, or Firm* — Dascenzo Intellectual Property Law, P.C.

(57) ABSTRACT

Footwear includes a shaft and a shell connected to the shaft. The shaft includes an expandable portion adapted to expand to facilitate ease of entry and exit of a heel of a foot into and out of the shell. The expandable portion is surrounded by a material forming the shaft.

29 Claims, 3 Drawing Sheets

(56) References Cited

U.S. PATENT DOCUMENTS

| | | | | | |
|---|---|---|---|---|---|
| 2,755,566 | A | | 7/1956 | Harrison | |
| 3,531,878 | A | * | 10/1970 | Corry | 36/109 |
| 3,744,158 | A | * | 7/1973 | Walker | 36/1.5 |
| 3,744,161 | A | | 7/1973 | Herunter | |
| 3,916,886 | A | * | 11/1975 | Rogers | 602/28 |
| 5,498,033 | A | | 3/1996 | Hoshizaki et al. | |
| 5,813,149 | A | | 9/1998 | Baker et al. | |
| 6,580,272 | B2 | | 6/2003 | Freed et al. | |
| 6,877,252 | B2 | | 4/2005 | Wilkinson | |
| 7,325,813 | B2 | | 2/2008 | Bock | |
| 7,980,010 | B2 | | 7/2011 | Davis et al. | |
| 2004/0088890 | A1 | | 5/2004 | Matis et al. | |
| 2005/0229436 | A1 | | 10/2005 | Bock | |
| 2011/0078924 | A1 | | 4/2011 | Rackiewicz et al. | |

FOREIGN PATENT DOCUMENTS

| | | | |
|---|---|---|---|
| DE | 29817495 | U1 | 12/2013 |
| EP | 1419707 | A1 | 5/2004 |
| EP | 1800555 | A1 | 6/2007 |
| KR | 200424815 | Y | 8/2006 |
| WO | 2010/017037 | A1 | 2/2010 |
| WO | WO 2004/039197 | A1 | 5/2014 |

OTHER PUBLICATIONS

English-language translation of German Patent No. 3519440, European Patent Office, Jan. 2, 1986.

European Search Report mailed Dec. 4, 2013 in EP Application No. 09805349.9, 7 pages.

* cited by examiner

FOOTWEAR WITH EXPANDABLE ENTRY AND EXIT FEATURE

RELATED APPLICATION

The present application is a continuation patent application that claims priority under 35 U.S.C. §120 to U.S. patent application Ser. No. 12/187,163, entitled "Footwear with Expandable Entry and Exit Feature," which was filed on Aug. 6, 2008, issued on Jul. 19, 2011 as U.S. Pat. No. 7,980,010, and the complete disclosure of which is hereby incorporated by reference herein.

FIELD OF THE INVENTION

This invention relates generally to footwear. More particularly, this invention is directed toward footwear with an expandable entry and exit system.

BACKGROUND OF THE INVENTION

For many individuals, the ease with which footwear can be put on and taken off is important. As a result, some individuals avoid certain footwear if it is difficult to put on or take off. Cowboy boots and Wellington-type boots are examples of footwear that is sometimes difficult to put on or take off. If the shaft (sometimes referred to as the quarter) of the boot has a large diameter, it is easier to get in and out of the boot, but the shaft may then be so large that it is difficult to have a pant leg fit over the shaft. Alternately, if the shaft has a narrower diameter, a pant leg can fit over the shaft, but it is difficult to put the boot on and take it off. In particular, with a standard or narrow diameter shaft, it may be difficult for an individual to manipulate the foot through the "turn" between the shaft and the shell or base of the boot. Zippers and other features may be added to such footwear, but these features frequently compromise aesthetics and materially increase manufacturing expenses.

Therefore, it would be desirable to provide footwear with an expandable entry and exit system. Such a system should facilitate entry and exit from the footwear, while maintaining desirable aesthetics and avoiding expensive manufacturing processes.

SUMMARY OF THE INVENTION

In one embodiment, footwear includes a shaft and a shell connected to the shaft. The shaft includes an expandable portion adapted to expand to facilitate ease of entry of a heel of a foot into the shell. The expandable portion is surrounded by a material forming the shaft.

In another embodiment, footwear includes a shaft having a front shaft section and a rear shaft section. The footwear also includes an upper shaft having a front upper section and a rear upper section. A shell is connected to the shaft. The upper shaft and the front shaft section are made of a first material and the rear shaft section is at least partially made of a second material different from the first material. The second material includes an expandable portion adapted to expand to facilitate ease of entry of a heel of a foot into the shell. The second material has a higher resilience than the first material.

BRIEF DESCRIPTION OF THE FIGURES

The invention is more fully appreciated in connection with the following detailed description taken in conjunction with the accompanying drawings, in which.

Like reference numerals refer to corresponding parts throughout the several views of the drawings.

DETAILED DESCRIPTION OF THE INVENTION

Embodiments of the invention include a technique for designing an article of footwear. In one embodiment, the disclosed article of footwear has been described in connection with a boot. The boot may include, but is not limited to, a cowboy boot, a hiking boot, a riding boot, a skate boot or a ski boot.

Figure 1:
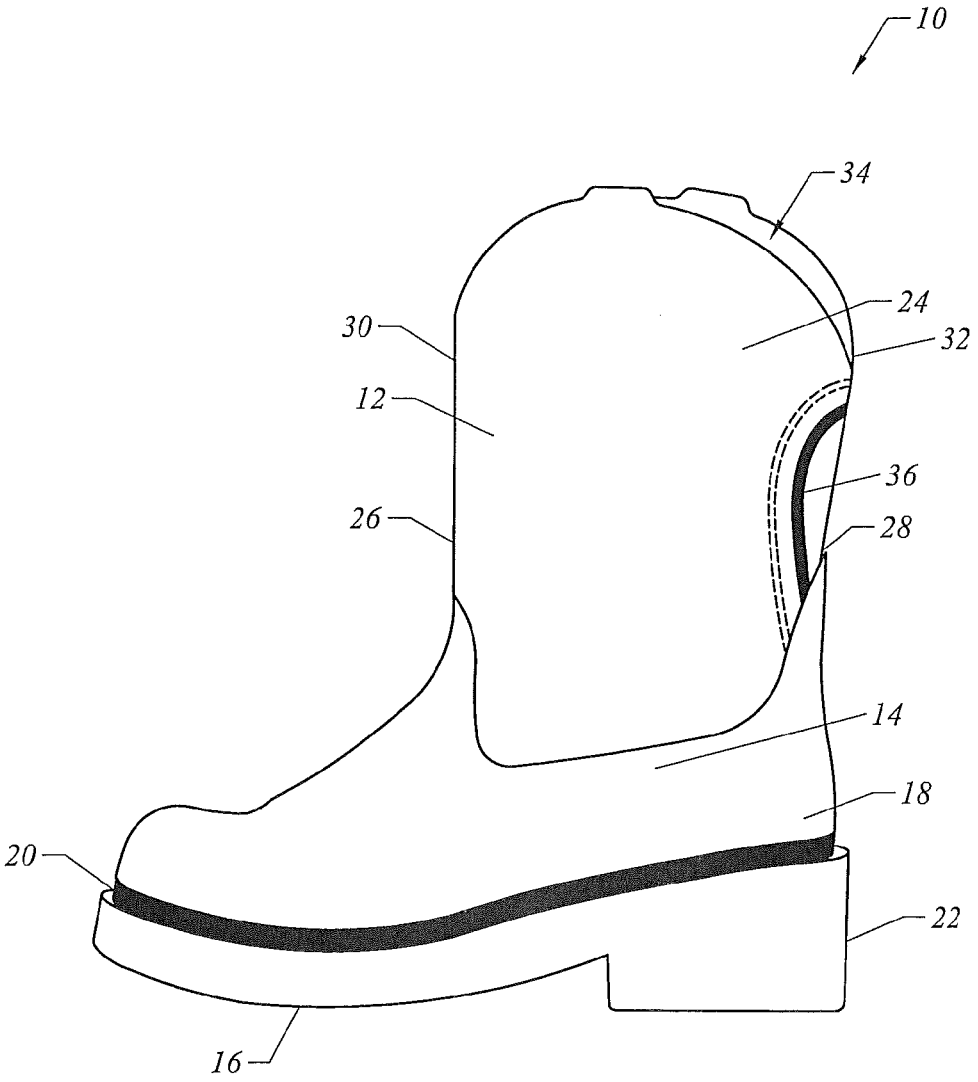
FIG. 1 is a side perspective view of footwear formed in accordance with one embodiment of the invention.

FIG. 1 is a side perspective view of footwear formed in accordance with one embodiment of the invention. The footwear 10 generally includes a shaft 12 and a shell or base 14 connected to the shaft 12. The shell 14 includes an outsole 16, an insole 18, a toe region 20, and a heel region that receives a heel portion of the wearer's foot when the footwear is worn by a wearer. The outsole 16 is typically rigid and may be made of solid rubber, one-piece molded rubber, molded synthetic rubber, leather or any other wear-resistant material that is flexible, lightweight and shock-absorbing. As shown in FIG. 1, the outsole 16 may include a heel portion 22 that extends away from the heel region of the boot shell and thus may be referred to as a projecting heel portion 22. The insole 18 and the toe region 20 provide the necessary arch, support, stability and protection for a wearer's foot. The insole 18 may be made of textile material such as cotton, felt, linen, polyester, leather, or other such materials known or used by one of ordinary skill in the art.

The shaft 12 includes a front shaft section 26 and a rear shaft section 28. The footwear 10 also includes an upper shaft 24, including a front upper shaft 30 and a rear upper shaft 32. The upper shaft 24 includes an opening 34. The shaft 12 and the upper shaft 24 are further defined by a first lateral section (e.g., an outsole lateral section) and a substantially opposed second lateral section (e.g., an insole lateral section not shown). The terms, front, rear and lateral are used with respect to the direction viewed by a person wearing the footwear, and is not intended to be limiting in any aspect. The shaft extends above the shell and defines a passage through which a wearer's foot is passed when the wearer's foot is inserted into and removed from the shell and within which at least an Achilles and lower calf region of the wearer's leg is positioned when the footwear is worn by the wearer.

In one embodiment, the shaft 12 includes an expandable portion 36 adapted to expand to facilitate ease of entry and exit of a heel of a foot into and out of the shell 14. In one embodiment, the expandable portion 36 is surrounded by a material forming the upper shaft 24 and the front shaft section 26. In a particular embodiment, the upper shaft 24 and the front shaft section 26 are made of a first material and the rear shaft section 28 is at least partially made of a second material different from the first material, where the second material includes the expandable portion 36. In one embodiment, the second material has a higher resilience than the first material. The material forming the upper shaft 24 and the front shaft section 26 may include leather, canvas, synthetic leather, fabric or other sufficiently durable and flexible materials known or used by one of ordinary skill in the art.

Figure 2:
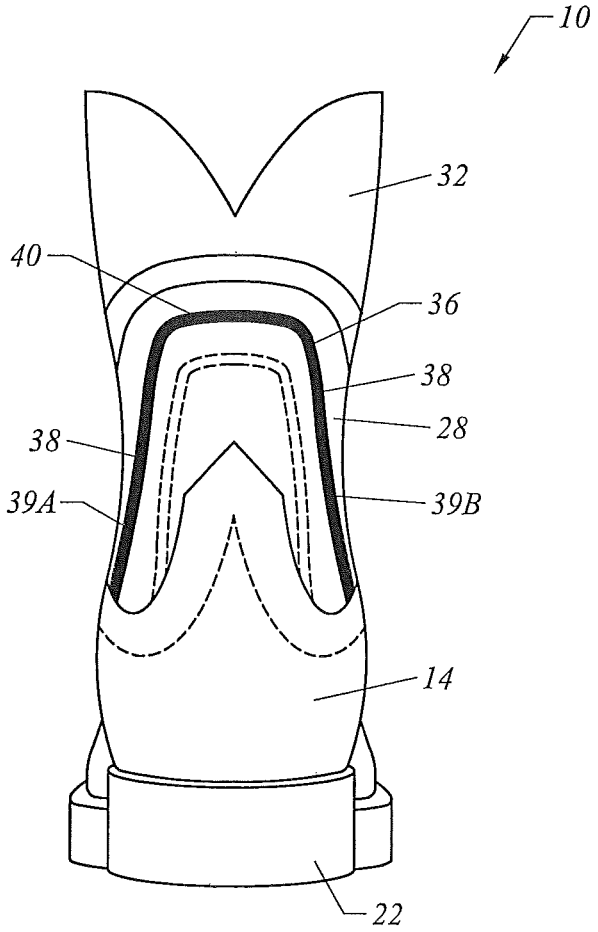
FIG. 2 is a rear view of footwear formed in accordance with one embodiment of the present invention.

FIG. 2 is a rear view of the boot 10. In one embodiment, the expandable portion 36 includes a stretchable material 38 sewn along at least a portion of the rear shaft section 28. The stretchable material 38 may be made up of material including, but not limited to, elastic, nylon, resilient leather, or other elastic fabric. In one embodiment, the stretchable material 38 is sewn over at least one vertical lane or aperture formed within the rear shaft section 28. FIG. 2 illustrates two vertical lanes: 39A and 39B. In an alternate embodiment, the stretchable material is sewn over at least one vertical lane and at least one horizontal lane 40 formed within the rear shaft section 28. A single vertical lane, multiple vertical lanes, a single horizontal lane, multiple horizontal lanes and combinations thereof may be used in various embodiments of the invention.

A reduced friction inner lining material (not shown) may be sewn along the interior rear shaft section 28 to promote ease of entry of the heel of the foot into the shell 14. The reduced friction inner lining material may be made up of material including, but not limited to, pre-processed leather, synthetic leather or fabric. The material forming the upper shaft 24 and the front shaft section 26 may additionally be printed with various decorative patterns to provide a fashionable and decorative appearance.

Observe in FIG. 2 that the expandable portion 36 extends upwardly from the shell 14 to a region proximate to the rear upper shaft 32. In one embodiment, the expandable portion 36 extends across at least a portion of an Achilles region from the shell 14 to a region proximate to the rear upper shaft 32.

Figure 3:
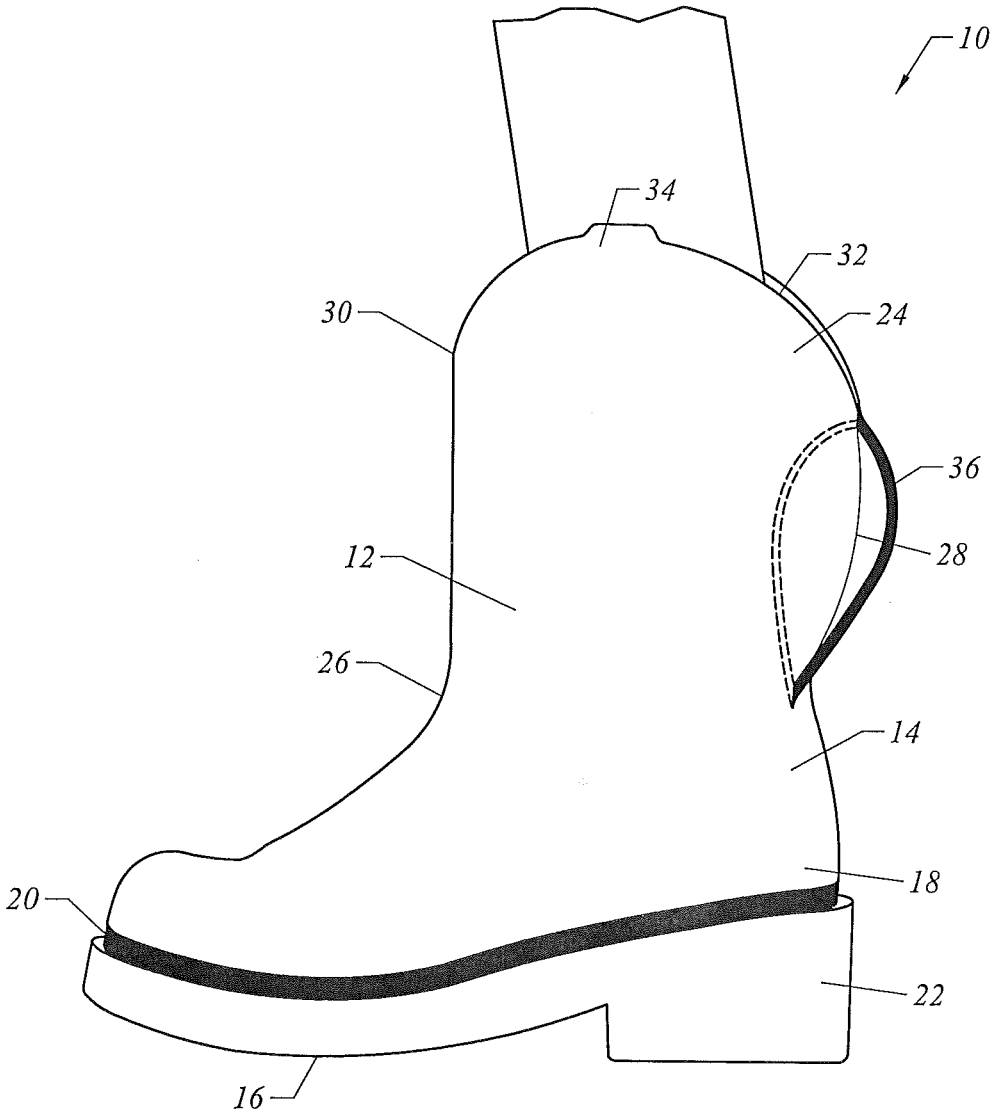
FIG. 3 is a side perspective view of the footwear, illustrating the reception of a lower leg and heel of a wearer's foot, in accordance with one embodiment of the invention.

FIG. 3 is a side perspective view of the footwear illustrating the reception of the lower leg and heel of a foot, in accordance with one embodiment of the present invention. The manner in which the stretchable material in the expandable portion 36 of the shaft 12 expands to facilitate the ease of entry of the heel of the wearer's foot is illustrated. As may be observed, the disclosed footwear design provides the wearer with a high degree of flexibility by providing the wearer with additional room to insert his/her foot, thereby enabling the ease of entry of the wearer's heel into the footwear. The same feature allows ease of exit from the footwear.

Various manufacturing techniques may be used to form footwear in accordance with the invention. The footwear may be formed and then apertures may be cut in the footwear. The resilient material may then be sewn over the apertures. Alternately, features defining the expandable portion may be preformed and then assembled in the manufacturing process.

Observe that the expandable portion is aesthetically integrated with the remaining design of the footwear. Also observe that from a manufacturing standpoint, the feature may be implemented with a relatively small expense compared to, for example, a zipper. The expandable portion allows for a shaft with a smaller diameter, therefore facilitating additional design operations. Accordingly, the shaft 12 of footwear 10 may be free of laces, free of buckles, free of zippers, and/or free of a releasable fastening mechanism for selectively reducing a diameter of the shaft.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

The invention claimed is:

1. A boot, comprising:

a boot shell configured to receive and extend around a wearer's foot when the boot is worn by the wearer, the shell including a toe region that receives a toe portion of the wearer's foot when the boot is worn by the wearer, a heel region that receives a heel portion of the wearer's foot when the boot is worn by the wearer, and an outsole having a projecting heel portion that extends away from the heel region of the boot shell; and a boot shaft connected to and extending above the boot shell to define a passage with an opening through which the wearer's foot is passed when the wearer's foot is inserted into and removed from the boot shell, wherein the boot shaft includes at least a front shaft section, a rear shaft section that includes an Achilles region within which at least the Achilles and lower calf region of the wearer's leg is positioned when the boot is worn by the wearer, and an upper shaft above the front and rear shaft sections;

wherein the boot shaft further includes an expandable portion (i) that is secured to the rear shaft section, (ii) that extends above the heel region of the boot shell, (iii) that does not extend to the opening, and (iv) that is adapted to expand resiliently to facilitate ease of entry of a heel of the wearer's foot through the passage and into the boot shell; wherein the expandable portion comprises:

(a) a flap that forms an exterior portion of the Achilles region of the rear shaft section; and (b) an elastic element that interconnects the flap with adjacent regions of the boot shaft and urges the flap sufficiently toward the adjacent regions to define at least one exposed narrow lane that borders the flap and is at least partially exposed from external the boot, wherein the elastic element is formed from a stretchable material that has a higher resilience than a shaft material of the adjacent regions of the boot shaft and the flap;

wherein the flap is adapted to bulge backwards with the heel of the wearer's foot as the wearer's foot is inserted through the passage and into the boot shell and to be drawn by the elastic element to return toward the adjacent regions upon the heel of the wearer's foot fully entering the shell; and wherein the boot is a cowboy boot, a riding boot, or a Wellington-type boot.

2. The boot of claim 1, wherein the boot shaft is free of a releasable fastening mechanism for selectively reducing a diameter of the boot shaft.

3. The boot of claim 1, wherein the flap extends from the shell away from the heel region.

4. The boot of claim 1, wherein the elastic element is sewn along at least a portion of the rear shaft section.

5. The boot of claim 1, wherein the at least one exposed narrow lane includes at least two lanes formed in the boot shaft.

6. The boot of claim 1, wherein the at least one exposed narrow lane includes two spaced-apart lanes.

7. The boot of claim 1, wherein the at least one exposed narrow lane includes at least two intersecting lanes.

8. The boot of claim 1, wherein the expandable portion does not extend into the upper shaft.

9. The boot of claim 1, wherein the at least one exposed narrow lane extends at least partially around three sides of the flap, and wherein the elastic element interconnects the three sides with the adjacent regions of the boot shaft.

10. The boot of claim 9, wherein the at least one exposed narrow lane does not extend all the way around the flap.

11. The boot of claim 10, wherein the flap bulges away from the front shaft section when the heel of the wearer's foot engages the expandable portion as the wearer's foot is inserted through the passage and into the shell.

12. The boot of claim 11, wherein the at least one exposed narrow lane extends between an upper portion of the flap and the adjacent region of the shaft above the upper portion of the flap, and further wherein the upper portion of the flap bulges farther away from the front shaft section than a lower portion of the flap when the heel of the wearer's foot engages the expandable portion as the wearer's foot is inserted through the passage and into the shell.

13. The boot of claim 1, wherein the flap is constructed of the same material as at least one of the heel region of the shell and the rear shaft section.

14. The boot of claim 1, wherein the at least one exposed narrow lane includes at least one vertical lane.

15. The boot of claim 1, wherein the at least one exposed narrow lane includes two spaced-apart vertical lanes.

16. The boot of claim 15, wherein a portion of the heel region of the boot shell extends between the two spaced-apart vertical lanes.

17. The boot of claim 1, wherein the stretchable material is selected from the group comprising elastic, nylon, and resilient leather.

18. The boot of claim 1, further comprising a reduced-friction inner lining material extending along the rear shaft section to promote ease of entry of the heel of the wearer's foot into the boot shell.

19. The boot of claim 1, wherein the upper shaft and the front shaft section are formed from the shaft material, and further wherein the stretchable material is a different material than the shaft material.

20. The boot of claim 1, wherein the entry of the heel of the wearer's foot into the boot shell is facilitated by the expandable portion providing additional room into which the wearer's foot can be inserted.

21. A boot, comprising:

a boot shell configured to receive and extend around a wearer's foot when the boot is worn by the wearer, the shell including a toe region that receives a toe portion of the wearer's foot when the boot is worn by the wearer, a heel region that receives a heel portion of the wearer's foot when the boot is worn by the wearer, and an outsole having a projecting heel portion that extends away from the heel region of the boot shell; and a boot shaft connected to and extending above the boot shell to define a passage with an opening through which the wearer's foot is passed when the wearer's foot is inserted into and removed from the boot shell, wherein the boot shaft includes at least a front shaft section, a rear shaft section that includes an Achilles region within which at least the Achilles and lower calf region of the wearer's leg is positioned when the boot is worn by the wearer, and an upper shaft above the front and rear shaft sections;

wherein the boot shaft further includes an expandable portion (i) that is secured to the rear shaft section, (ii) that extends above the heel region of the boot shell, (iii) that does not extend to the opening, and (iv) that is adapted to expand resiliently to facilitate ease of entry of a heel of the wearer's foot through the passage and into the boot shell; wherein the expandable portion comprises:

(a) a flap that forms an exterior portion of the Achilles region of the rear shaft section; and (b) an elastic element that interconnects the flap with adjacent regions of the boot shaft and urges the flap sufficiently toward the adjacent regions to define at least one exposed narrow lane that borders the flap and is at least partially exposed from external the boot, wherein the elastic element is formed from a stretchable material that has a higher resilience than a shaft material of the adjacent regions of the boot shaft and the flap;

wherein the flap is adapted to bulge backwards with the heel of the wearer's foot as the wearer's foot is inserted through the passage and into the boot shell and to be drawn by the elastic element to return toward the adjacent regions upon the heel of the wearer's foot fully entering the shell; and wherein the boot shaft is free of laces, buckles, and zippers for selectively reducing a diameter of the boot shaft.

22. The boot of claim 21, wherein the at least one exposed narrow lane extends at least partially around three sides of the flap, and wherein the elastic element interconnects the three sides with the adjacent regions of the boot shaft.

23. The boot of claim 22, wherein the at least one exposed narrow lane does not extend all the way around the flap.

24. The boot of claim 23, wherein the flap bulges away from the front shaft section when the heel of the wearer's foot engages the expandable portion as the wearer's foot is inserted through the passage and into the shell.

25. The boot of claim 24, wherein the at least one exposed narrow lane extends between an upper portion of the flap and the adjacent region of the shaft above the upper portion of the flap, and further wherein the upper portion of the flap bulges farther away from the front shaft section than a lower portion of the flap when the heel of the wearer's foot engages the expandable portion as the wearer's foot is inserted through the passage and into the shell.

26. The boot of claim 21, wherein the boot is a cowboy boot, a riding boot, or a Wellington-type boot.

27. The boot of claim 21, further comprising a reduced-friction inner lining material extending along the rear shaft section to promote ease of entry of the heel of the wearer's foot into the boot shell.

28. The boot of claim 21, wherein the expandable portion does not extend into the upper shaft.

29. The boot of claim 21, wherein the entry of the heel of the wearer's foot into the boot shell is facilitated by the expandable portion providing additional room into which the wearer's foot can be inserted.

* * * * *